US006422293B1

(12) United States Patent
Comarteau et al.

(10) Patent No.: US 6,422,293 B1
(45) Date of Patent: Jul. 23, 2002

(54) METHOD AND INSTALLATION FOR LOW PRESSURE DIE CASTING IN A MOULD CERAMIC CASTING DIE

(75) Inventors: Jean-Louis Comarteau, Chatenoy le Royal; Christophe Liebaut, Mercurey; Alain Reny, Chalon s/Saone; Didier Thomas, Saint-Denis de Vaux, all of (FR)

(73) Assignee: SEVA, Chalon sur Saone (FR)

( * ) Notice: Subject to any disclaimer, the term of this patent is extended or adjusted under 35 U.S.C. 154(b) by 0 days.

(21) Appl. No.: 09/380,463

(22) PCT Filed: Dec. 29, 1998

(86) PCT No.: PCT/FR98/02908

§ 371 (c)(1),
(2), (4) Date: Nov. 18, 1999

(87) PCT Pub. No.: WO99/34945

PCT Pub. Date: Jul. 15, 1999

(30) Foreign Application Priority Data

Jan. 7, 1998 (FR) ..... 98 00091

(51) Int. Cl.[7] ..... B22D 18/04; B22D 18/06

(52) U.S. Cl. ..... 164/63; 164/119

(58) Field of Search ..... 164/63, 119, 306, 164/254, 255

(56) References Cited

U.S. PATENT DOCUMENTS

| | | | |
|---|---|---|---|
| 4,445,670 | A | 5/1984 | Hayashi |
| 5,069,271 | A | 12/1991 | Chandley et al. |

FOREIGN PATENT DOCUMENTS

| | | |
|---|---|---|
| FR | 2 534 167 | 4/1984 |
| FR | 2 556 996 | 6/1985 |
| JP | 3-057549 | 3/1991 |
| JP | 4-187359 | 7/1992 |

*Primary Examiner*—Kuang Y. Lin
(74) *Attorney, Agent, or Firm*—Wenderoth, Lind & Ponack, L.L.P.

(57) ABSTRACT

Placed in a box (1) is a ceramic shell (21) delimiting a casting space (22), the shell being surrounded by a mass of binder-free sand (23). The casting space is connected to a source (4) of liquid metal located underneath, in which are applied, in succession, a pressure (P1) bringing the liquid to the threshold of the casting space (22), a pressure (P2) slightly greater than that necessary for filling this space, and then a marked overpressure (P3); finally, the pressure is brought back down to the first value (P1). When the casting space has been filled, an underpressure is created in the space containing the mass of sand (23) in order to prevent any deformation of the shell (21) due to the overpressure (P3), at least until the formation of a metal skin against the shell and at most until the start of the reduction in the overpressure in the source (4) of liquid metal.

21 Claims, 2 Drawing Sheets

METHOD AND INSTALLATION FOR LOW PRESSURE DIE CASTING IN A MOULD CERAMIC CASTING DIE

BACKGROUND OF THE INVENTION

The invention relates to a process and to a plant for low-pressure casting of a metallic composition in the liquid state in a mold comprising a ceramic shell, one face of which delimits a casting space, and a mass of binder-free sand in contact with the other face of the shell, the mold being placed in a box having at its base an access joined to the casting space and connected via a liquid-metal feed pipe to a source of liquid metal located underneath, for example a casting furnace.

Already known are casting processes and plans of this type, in which the source of liquid metal, such as a casting furnace, is brought into communication with a source of gas under pressure in such a way that the liquid metal contained in the source of liquid metal is pressurized to a first pressure value by means of which the liquid metal is brought into and maintained in the region of the access of the box for this liquid metal.

When a casting is desired to be cast, by introducing liquid metal into the mold, the level of the liquid metal is raised above the threshold of the mold where it was, by increasing the pressure up to a second value slightly greater than the value necessary for making the liquid metal fill the casting space, so as to have a safety margin and to be certain that all the intricacies of the mold, even the highest ones, are filled with liquid metal, and the pressure is maintained at this second value for a time long enough to allow a rest phase, and a low metallostatic pressure on the walls of the ceramic shell. The pressure is then increased further to a third value so as to fill up any shrinkage cavities or holes, and the pressure is maintained at this third value for a time allowing the desired solidification of the metal contained in the mold to take place, after which the pressure is reduced so that the level of the unused liquid metal goes down to approximately the initial level, and this pressure is maintained for the time necessary, for example, to remove the mold, de-mold the casting and put a new mold in place to allow manufacture of another casting.

However, the ceramic shells of these molds generally have an extremely small thickness and thus a degree of flexibility which, when they are subjected to the pressure of the liquid metal, makes them tend to suffer deformations which impair their dimensional stability. In order to overcome any dimensional instability that might occur in the case of the casting process described above, it has been proposed to keep the mass of sand in contact with the shell at an underpressure, so as to provide the grains of sand with dynamic stability and thus to ensure that the shell is dimensionally stable. For this purpose, the box is provided with a second access joined to the space containing the mass of sand and connected via a suction pipe to a device for creating an underpressure.

However, creating an underpressure in the mass of sand in this way has the drawback of disturbing the rise and the proper distribution of the liquid metal in the casting space by means of the porosity of the ceramic ("vacuum" filling), which in turn causes too rapid filling, producing defects in the castings.

SUMMARY OF THE INVENTION

The object of the invention is to overcome these drawbacks and relates for this purpose to a process for low-pressure casting in a mold comprising a ceramic shell, one face of which delimits a casting space, and a space containing a mass of binder-free sand in contact with the other face of the shell, the mold being placed in a box having at its base an access joined to the casting space and connected to a source of liquid metal placed underneath, in which process the liquid metal in the source is pressurized to a first pressure value suitable for bringing liquid metal into the region of the access, the pressure is increased to a second value slightly greater than the value necessary for filling the casting space and this second value is maintained for a first predetermined time, the pressure is then increased to a third value and this third value is maintained for a second predetermined time, the pressure is then reduced so that the level of the liquid metal goes down, approximately into the region of the access or below, characterized in that, approximately when the casting space becomes entirely filled with liquid metal, the pressure in the space containing the mass of sand is reduced to below atmospheric pressure to a predetermined underpressure value, this underpressure value is maintained at least until a solidified skin is obtained against the shell and the pressure in the space containing the mass of sand is brought back up to approximately atmospheric pressure.

The process according to the invention may also have one or more of the following characteristics:

- the duration of the phase during which the pressure in the space containing the mass of sand is reduced to below atmospheric pressure, to a predetermined underpressure value, is shorter than the first predetermined time;
- the phase during which the pressure in the space containing the mass of sand is increased, to approximately atmospheric pressure, is brought to its completion before the completion of the phase during which the pressure to which the liquid metal contained in the source of liquid metal is subjected is decreased, in such a way that the level of the liquid metal goes down approximately into the region of the access or below;
- the predetermined underpressure value corresponds to an absolute pressure in the range of approximately 0.5 to 0.9 bar;
- the first pressure value is about 1.15 bar absolute;
- the second pressure value is about 1.4 bar absolute;
- the third pressure value is about 1.7 bar absolute.

By virtue of the fact that it is only when the casting space is filled with liquid metal that the pressure in the space containing the mass of sand is reduced, the filling is not disturbed by the underpressure.

The invention also relates to a plant for implementing the above process, which includes a mold comprising a ceramic shell, one face of which delimits a casting space, and a space containing a mass of binder-free sand in contact with the other face of the shell, the mold being placed in a box having at its base an access joined to the casting space and connected to a source of liquid metal located underneath, which plant is characterized in that the box includes, on the inside, a vacuum chamber provided with at least one region of an air-permeable wall and having an access opening fitted with a vacuum connector in order to be connected to a suction device via a solenoid valve controlled by a programmable controller which also controls a device for regulating the pressure in the source of liquid metal.

The plant according to the invention may also be characterized in that the vacuum chamber extends annularly in the box against a base wall and side walls of the box.

By virtue of this plant, the molding process may be very rapidly implemented and accurately controlled with an installation investment that nevertheless remains modest.

BRIEF DESCRIPTION OF THE DRAWINGS

Further characteristics and advantages of the invention will emerge from the description which follows of an embodiment of the invention, illustrated by the appended drawings in which.

DETAILED DESCRIPTION OF THE INVENTION

Figure 1:
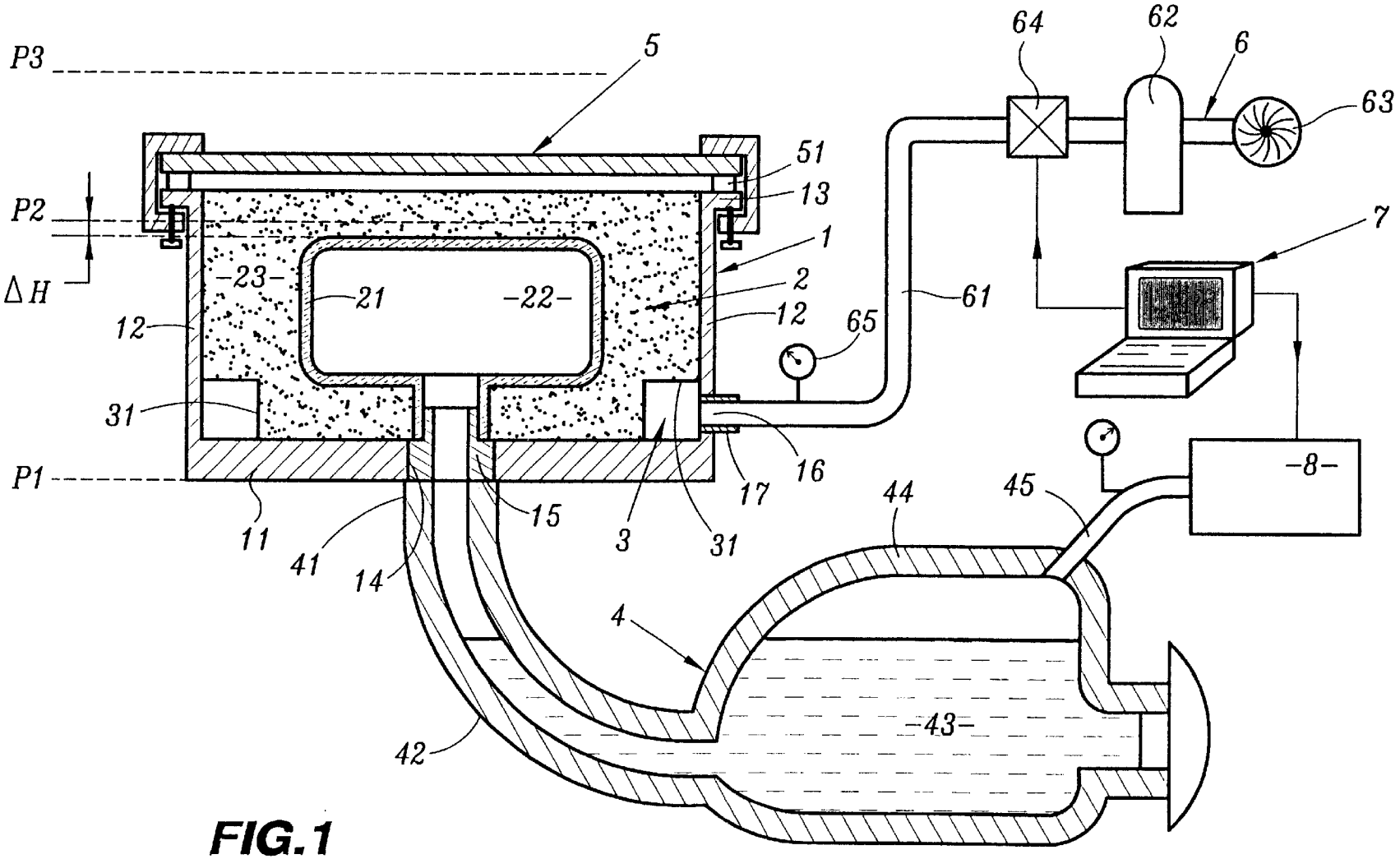
FIG. 1 is a general diagram of a plant for implementing the process according to the invention.

A plant according to the invention includes a box 1 in which there is a mold 2 comprising a ceramic shell 21, possibly of the "consumable" type, one face of which delimits a casting space 22 whose shape corresponds to the external shape of the casting to be cast, and a mass of binder-free sand 23 in the space in the box delimited between the wall of the latter and the other face of the shell and thus in contact with this other face.

By virtue of the invention, the thickness of the shell 21 may' be small—a 2 mm thickness may, for example, be achieved.

In general, the thickness lies within the 2 to 4 mm range, but the process is also suitable for greater thicknesses.

The box 1 has a base wall 11 and side walls 12 having an edge common with the base wall and an upper edge bent over outwards so as to form a flange 13 extending parallel to the base wall.

The base wall has an access opening 14 joined to the casting space 22 by a tubular joint 15 having a part fitted into the opening of the base wall and a part serving as a bearing surface for the internal face, of matching shape, of the mouth (on the underside) of the shell 21.

The box 1 includes an annular vacuum chamber 3 extending against the peripheral region of its base wall 11 and the regions of the side walls 12 which abut this base wall. This vacuum chamber has at least one wall 31 in contact with the mass of sand 23; this wall 31 includes at least one region which is permeable to air but impermeable to sand. One of the side walls of the box 1 and of the vacuum chamber 3 has a second access opening 16 emerging in the vacuum chamber and fitted with a vacuum connector 17.

The mass of sand 23 fills the space in the box 1 between the walls of the latter and the shell 21, apart from the vacuum chamber 3.

The box is placed on a support plate (not shown) having an opening facing the access opening in its base wall.

For the purpose of filling the box with sand, for example by means of a hopper whose base orifice emerges in the box, the support plate is firstly placed on a vibration device (also not shown) which includes, for example, eccentric rollers.

Thus, when the shell 21 is positioned on the joint 15, the box 1 may be filled with loose sand, that is to say binder-free sand, while still being vibrated in order to obtain maximum densification. The sand level is then evened off using a screed in order to obtain a uniform level at the upper surface of the box.

The box 1 filled with sand is then ready to be transported to a point near a casting furnace 4 which is located underneath the box. The box is positioned in such a way that the access opening 14 of its base wall fitted with the joint 15 is opposite an outlet neck 41 of a pipe 42 for feeding liquid metal from the furnace, so that the neck can be fastened to the box and the feed pipe thus connects the casting space of the mold to the internal space of the furnace.

In addition, a movable plate 5, under which a gasket 51 is fixed, is attached to the box, for example by clamping, in order to form the lid of the box, the gasket 51 then being interposed between the plate and the flange 13 formed on the side walls of the box. The gasket, compressed between the plate and the flange, matching the shape of these, therefore allows a vacuum to be created inside the box.

At approximately the same time as the movable plate is applied to the box, the vacuum connector 17 is connected in a sealed manner to a suction pipe 61 connecting this connector to a suction device 6 comprising a vacuum header 62 in which an underpressure is created by a pump 63, such as a vane pump.

A solenoid valve 64 controlled by a programmable controller 7 is inserted between the vacuum header 62 and the vacuum connector 17 of the box; a pressure gauge 65 measures the pressure at the inlet of the box.

The casting furnace 4 includes, above the mass 43 of liquid metal, a roof 44 connected by a pressurization pipe 45 to a device 8 for regulating the pressure, this device also being controlled by the programmable controller 7.

Figure 2:
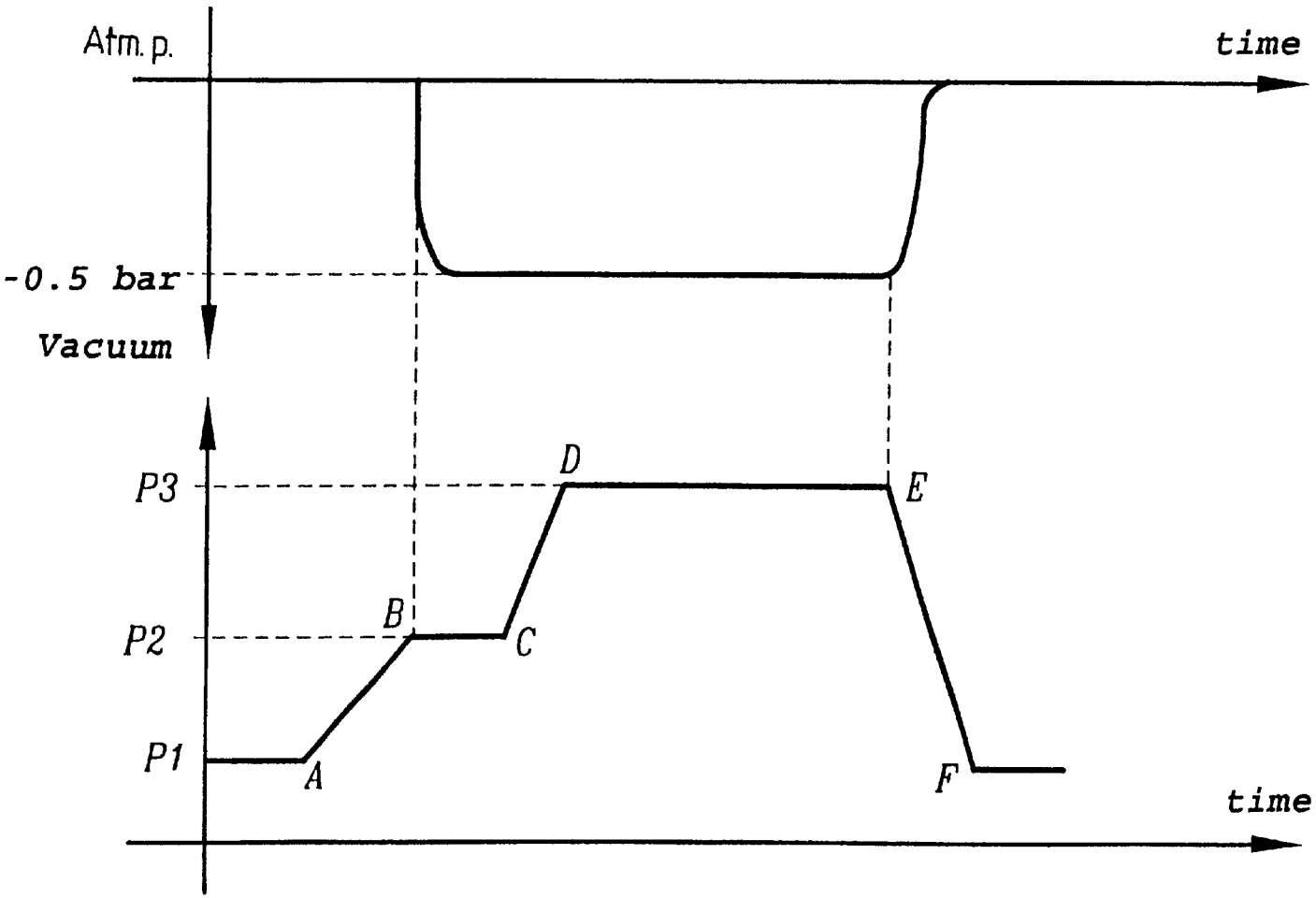
FIG. 2 is a plot illustrating the succession of phases of the process according to the invention.

By virtue of this plant, and under the control of the programmable controller 7, it is possible to implement the process according to the invention which will be described below and which is illustrated by FIG. 2.

The liquid metal in the casting furnace 4 is pressurized by means of the pressurization pipe 45 to a pressure value P1, for example of about 1.15 bar absolute, which brings the liquid metal, via an ascending movement into the region of the access opening 14 of the base of the box 1, to the threshold of the mouth of the mold 2.

The pressure is then increased (phase AB) to a value P2, for example about 1.4 bar absolute, and more generally a value slightly greater than that necessary for completely filling, from below, the casting space with a sufficient safety margin ≠h, Δand this value is maintained in order to allow a rest phase (phase BC) to be established.

In addition, when the pressure has reached approximately its value allowing the mold to be filled, and preferably its value P2 with the safety margin (point B), the pressure in the mass of sand is rapidly reduced by means of the suction pipe and after opening the solenoid valve 64 controlled by the programmable controller 7; the pressure continues to be reduced until an underpressure value with respect to atmospheric pressure, preferably corresponding to a predetermined absolute pressure approximately in the range from 0.5 to 0.9 bar, is reached and this underpressure value is maintained for a certain time, as will be seen below.

Preferably, the pressure in the space containing the mass of sand is reduced rapidly, since the duration of this reduction phase to a pressure below atmospheric pressure to a chosen underpressure value must be shorter than that of the phase BC during which the mass of liquid metal is subjected to the pressure value P2. According to the invention, the pressure of the liquid metal is therefore maintained at the value P2, in this case 1.4 bar, not only until the cavity 22 has been filled but also until the underpressure in the mass of sand has reached the chosen level.

Thereafter, since the shell 21 is stiffened by the compacting of the mass of sand due to the underpressure, the pressure applied to the liquid metal is increased further (phase CD) to a value P3, for example of about 1.7 bar, so as to fill any shrinkage cavities or holes, and this overpressure value P3 is maintained for a time allowing, first of all, a solidified skin to be formed against the shell and then the metal contained in the mold to solidify (phase DE).

The underpressure in the mass of sand is maintained at a value corresponding to an absolute pressure in this case of approximately 0.5 to 0.9 bar until the point E, and in all cases the "vacuum" must not be "broken" before the skin of metal against the shell 21 has been formed.

When the desired solidification of the metal in the casting space 22 has taken place, the pressure on the liquid metal is reduced (phase EF) in such a way that its level comes back down to approximately the initial value (in this case, a pressure value P1 of about 1.15 bar) and this pressure is maintained for the time necessary, for example, to remove the mold and to fit another one for the purpose of manufacturing another casting. As was seen, the "vacuum" may be broken (the pressure increased) in the mass of sand after the solid skin has formed, but generally this operation is carried out only immediately before the pressure applied to the liquid metal is released or at the time of this release; however, this phase of increasing the pressure in the space containing the mass of sand to approximately atmospheric pressure is carried out sufficiently soon and/or rapidly so that it is completed before the completion F of the phase EF during which the pressure on the liquid metal is reduced in order to return it to the pressure P1 or even below. Since the mass of sand is no longer at an underpressure, the liquid metal can go back down freely into the feedpipe 42, its level then returning to approximately the region of the access 14 or below and the box can be easily removed without any risk of liquid metal returning.

Thus, by virtue of the invention, since the underpressure is applied to the mass of sand after the shell has been filled, it has no effect on the flow of the metal in the latter, and this flow remains controlled by the pressure, whereas the underpressure in the mass of sand ensures that the shell is stiffened during the overpressure phase at the pressure P3, which is the most critical, at least until the shell has been stiffened by a skin of metal.

What is claimed is:

1. A process for low-pressure casting in a mold (2) comprising a ceramic shell (21), one face of which delimits a casting space (22), and a space containing a mass of binder-free sand (23) in contact with the other face of the shell, the mold being placed in a box (1) having at its base an access (14) joined to the casting space and connected to a source (4) of liquid metal placed underneath, said process comprising: pressurizing the liquid metal in the source to a first pressure value (P1) suitable for bringing liquid metal into the region of the access; increasing the pressure to a second pressure value (P2) slightly greater than a pressure value necessary for filling the casting space; maintaining the second pressure value for a first predetermined time (BC), and then increasing the pressure to a third pressure value (P3); maintaining the third pressure value for a second predetermined time (DE), and then reducing the pressure so that the level of the liquid metal goes down, approximately into the region of the access (14) or below; approximately when the casting space becomes entirely filled with liquid metal, reducing the pressure in the space containing the mass of sand (23) to below atmospheric pressure to a predetermined underpressure value; maintaining the underpressure value at least until a solidified skin is obtained against the shell (21); and raising the pressure in the space containing the mass of sand to approximately atmospheric pressure.

2. The process according to claim 1, wherein said reducing and maintaining of the pressure in the space containing the mass of sand (23) to a predetermined underpressure value, has a duration shorter than the first predetermined time (BC).

3. The process according to claim 1, wherein said raising of the pressure in the space containing the mass of sand (23) to approximately atmospheric pressure, is completed before completion (F) of said reducing of the pressure to which the liquid metal contained in the source (4) of liquid metal is subjected in such a way that the level of the liquid metal goes down approximately into the region of the access (14) or below.

4. The process according to claim 1, wherein said predetermined underpressure value corresponds to an absolute pressure in the range of approximately 0.5 to 0.9 bar.

5. The process according to claim 1, wherein said first pressure value (P1) is about 1.15 bar absolute.

6. The process according to claim 1, wherein said second pressure value (P2) is about 1.4 bar absolute.

7. The process according to claim 1, wherein said third pressure value (P3) is about 1.7 bar absolute.

8. The process according to claim 2, wherein said predetermined underpressure value corresponds to an absolute pressure in the range of approximately 0.5 to 0.9 bar.

9. The process according to claim 3, wherein said predetermined underpressure value corresponds to an absolute pressure in the range of approximately 0.5 to 0.9 bar.

10. The process according to claim 2, wherein said first pressure value (P1) is about 1.15 bar absolute.

11. The process according to claim 3, wherein said first pressure value (P1) is about 1.15 bar absolute.

12. The process according to claim 4, wherein said first pressure value (P1) is about 1.15 bar absolute.

13. The process according to claim 2, wherein said second pressure value (P2) is about 1.4 bar absolute.

14. The process according to claim 3, wherein said second pressure value (P2) is about 1.4 bar absolute.

15. The process according to claim 4, wherein said second pressure value (P2) is about 1.4 bar absolute.

16. The process according to claim 5, wherein said second pressure value (P2) is about 1.4 bar absolute.

17. The process according to claim 2, wherein said third pressure value (P3) is about 1.7 bar absolute.

18. The process according to claim 3, wherein said third pressure value (P3) is about 1.7 bar absolute.

19. The process according to claim 4, wherein said third pressure value (P3) is about 1.7 bar absolute.

20. The process according to claim 5, wherein said third pressure value (P3) is about 1.7 bar absolute.

21. The process according to claim 6, wherein said third pressure value (P3) is about 1.7 bar absolute.

* * * * *

UNITED STATES PATENT AND TRADEMARK OFFICE

CERTIFICATE OF CORRECTION

PATENT NO. : 6,422,293 B1
DATED : July 23, 2002
INVENTOR(S) : Jean-Louis Comarteau It is certified that error appears in the above-identified patent and that said Letters Patent is hereby corrected as shown below:

Title page,
Item [75], the third-listed inventor's name should read -- Alain Remy --.

Signed and Sealed this

Seventeenth Day of December, 2002

JAMES E. ROGAN
*Director of the United States Patent and Trademark Office*

UNITED STATES PATENT AND TRADEMARK OFFICE

CERTIFICATE OF CORRECTION

PATENT NO. : 6,422,293 B1
DATED : July 23, 2002
INVENTOR(S) : Jean-Louis Comarteau It is certified that error appears in the above-identified patent and that said Letters Patent is hereby corrected as shown below:

Title page,
Item [75], the third-listed inventor's name should read -- Alain REMEY --.

Signed and Sealed this

Twenty-first Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,422,293 B1
DATED : July 23, 2002
INVENTOR(S) : Jean-Louis Comarteau It is certified that error appears in the above-identified patent and that said Letters Patent is hereby corrected as shown below:

Title page,
Item [75], the third-listed inventor's name should read -- Alain Remy --.

This certificate supersedes Certificate of Correction issued December 17, 2002 and January 21, 2003.

Signed and Sealed this

Twenty-seventh Day of May, 2003

JAMES E. ROGAN
*Director of the United States Patent and Trademark Office*